US005965002A

United States Patent [19]

Udofot

[11] Patent Number: 5,965,002

[45] Date of Patent: Oct. 12, 1999

[54] ELECRODEPOSITION OF MANGANESE AND OTHER HARD TO DEPOSIT METALS

[76] Inventor: Bassey J. Udofot, 3937 Encino St., Colorado Springs, Colo. 80918

[21] Appl. No.: 08/968,291

[22] Filed: Nov. 12, 1997

[51] Int. Cl.[6] ..... C25D 3/56

[52] U.S. Cl. ..... 205/256; 205/255; 205/257; 205/238

[58] Field of Search ..... 205/255, 257, 205/256, 238

[56] References Cited

PUBLICATIONS

Chemical Abstract 1968:110743, (No Date Available).

*Primary Examiner*—K. Mayekar
*Attorney, Agent, or Firm*—Ruth Eure

[57] ABSTRACT

A method of codepositing iron and manganese having a high proportion of manganese incorporates use of a new electrochemical cell. The deposit comprises up to 38% manganese from a solution of wide ranging pH from an aqueous bath of sulfate, phosphate salt or any other type of bath, The deposits may subsequently be nitrided, phosphatized or carburized to produced an amorphous surface comparable to Hadfield steel. The manganese alloy deposit exhibits a bright, shiny surface.

15 Claims, 2 Drawing Sheets

| ELMT | APP.CONC | ERROR(WT%) |
|---|---|---|
| MnK : 1 | 22.195 | .189 |
| FeK : 1 | 35.040 | .257 |
| CuK : 1 | .189 | .115 * Between 1 and 2 Sigma * |
| S K : 1 | 18.446 | .103 |

ZAF CALCULATIONS

...[ 3 iterations]

20.00 kV TILT = .00 ELEV = 30.00 AZIM = .00 COSINE = 1.000

Spectrum: PH2SOLDMA100 42-AR

All elmts analysed

| ELMT | ZAF Ratio | %ELMT | | Error | ATOM.% |
|---|---|---|---|---|---|
| MnK : 1 | .926 | 23.973 | +- | .205 | 25.660 |
| FeK : 1 | .952 | 36.824 | +- | .270 | 38.774 |
| CuK : 1 | .846 | .223 | +- | .136 <2 sd , below confidence limit | |
| S K : 1 | .951 | 19.389 | +- | .108 | 35.566 |
| TOTAL | | 80.185 | | | 100.000 |

ELECRODEPOSITION OF MANGANESE AND OTHER HARD TO DEPOSIT METALS

DEPOSITION OF MANGANESE AND OTHER HARD TO DEPOSIT METALS

This patent application claims priority of Great Britain patent application GB 9623846.4, filed Nov. 16, 1996 in abstract form, and in full form before Nov. 16, 1997, both of which are incorporated herein in their entirety by reference thereto as though the same were fully set forth herein.

FIELD OF THE INVENTION

The present invention relates generally to the field of electrochemical processes.

BACKGROUND OF THE INVENTION

Deposition of manganese onto ferritic and other surfaces has heretofore met with little success. The present invention teaches a method of depositing manganese and other hard-to-deposit metals such as titanium, vanadium, and zirconium.

Alloys of steel containing manganese (Mn) and about 1 to 1.2% carbon exhibit excellent hardness, average ductility, and excellent resistance to corrosion and wear. This is due to the presence of a highly stable $MnO_2$ film that forms on the surface. This oxide film is superior to nickel and chromium oxide films which do not effectively protect steel against wear and corrosion. Ferro-manganese steel has historically been prepared by casting or thermal processes. These processes are primitive, time-consuming, expensive, and generally produced steels high in sulfur and phosphorous.

Prior art processes for deposition of manganese have been taught by Campbell, achieving a deposition of 10% manganese. The present invention has demonstrated a deposition of manganese at about 38%. Campbell reported on the deposition of manganese nickel and manganese iron alloys. (See A. L. Campbell, *Electrolytic formation of alloys and amalgams of manganese,* F. Chem. Society, 125, 1713–1719 (1924). Campbell was trying to determine whether codeposition of iron-group metals with manganese resulted in anomalous deposition potentials as was observed in the deposition of the iron-group metals with zinc. The bath of Campbell contained the sulfates of manganese, the iron-group metal and ammonia. Campbell obtained bright, smooth deposits at a current density of 8 $MA/cm^2$ containing about 10% manganese. The cathode current density was about 15%. The baths of Campbell were also used by Agladze and Gdzelishvili who investigated the anodic dissolution of iron-manganese in an electrolyte solution containing 83% manganese and 8% iron and ammonium sulfates to deposit a manganese iron alloy onto the cathode. (See, R. I. A. Gladze and M. Y. A. Gdzelishvili, *Electrodeposition of Iron-Manganese Alloys,* Soobsh. Akad. Nauk Gruzinskoi S. R. 9, 555–562 (1949). At current density less than about 3 $am/dm^2$, 15° C.; pH 3.1, the anode dissolved to yield manganese and ferric ions. Some iron hydroxide precipitated and caused passivation of the anode. Gladze showed that at higher current densities manganese went into solution as ammonium permanganate, and iron entered the solution as ferric ions. The cathode contained between 2 and 16% iron, and the composition of the deposit was not significantly affected by variations in plating conditions.

Manganese alloys are difficult to deposit because manganese is very electronegative in aqueous solutions. As a general rule, co-deposition takes place when the electronegativities of its components parts are within 200 mV of each other. Manganese, having an electronegativity of 1.18 volts, is far removed from the potentials of other depositable metals. See, Brenner, Abner; *Electrodeposition of Alloys: Principle and Practice,* Vols. 1 and 11, Academic Press, New York and London, 1963. One approach to effectively deposit manganese alloys is the use of complexing agents to shift the deposition potential of a more noble metal to closer to that of manganese to bring about codeposition. This approach has been largely unsuccessful because the complexing agent degrades the quality of the deposit. Manganese alloys (except copper, tin and nickel) are deposited from a slightly acid bath of simple ions. In addition to the difficulty of deposition, manganese has three drawbacks including brittleness, dark black color and high reactivity. The chief use of electrodeposited manganese or its alloys is protective coatings for steel or other metals. Brenner concluded that the deposition of manganese alloys of the iron group metals has four characteristics: namely, (a) the alloys contained low percentages of manganese usually not exceeding 12%; (b) the alloys deposited at low cathode current efficiencies of about 20%; (c)iron manganese could only be deposited in a mildly acid salt solution; and (d) at higher pH, hydroxide precipitated and the bath became inoperable.

SUMMARY OF THE INVENTION

It is an object of the present invention to teach a method of depositing manganese and other hard-to-deposit metals such as titanium, vanadium, and zirconium.

It is a further object of the present invention to electrochemically deposit iron-manganese (also referred to as Fe-Mn or Mn-Fe) alloys from aqueous solutions of simple acid salts.

It is a still further object of the present invention to teach a new electrochemical cell, which can be used with or without a separation chamber for deposition of manganese, manganese alloys and other hard-to-deposit metals such as vanadium, titanium and zirconium with or without the use of a complexing agent.

It is a still further object of the present invention to teach a new electrochemical cell having controllable preferential discharge and controllable diffusion of ions in solution.

It is a still further object of the present invention to teach a method of co-depositing iron, manganese and phosphate containing about 12 to about 50% Mn for corrosion resistance and frictional wear resistance.

It is a still further object of the present invention to teach a method of co-depositing iron, manganese and phosphate containing about 12 to about 50% Mn for corrosion resistance and frictional wear resistance having a variety of surfaces ranging from a bright, shiny surface to a dark surface.

It is a still further and primary object of the present invention to provide a method of making an equivalent of Hadfield austenitic manganese steel containing about 12–15% Mn, and about 1–1.2% carbon. The carbon can be interstitially diffused into the crystal lattice structure of the alloy deposit by a well known carburization process, well known to the skilled artisan. Carburization is then followed by heat treatment and annealing to align the distorted grains of the alloy deposit.

Deposition of manganese and other hard to deposit metals from a strong acid, mild acid, or neutral or alkaline aqueous solution is also taught. These solutions contain a wide range of pH, including pH of: 0.5, 1, 2, 3, 4, 5, 6, 7, 8, 9 and 10; and current densities of 20 to 872 MA/cm$^2$ at temperatures from 8 to 45° C. Although the processes of the present invention are described with respect to manganese, it is to be understood that these processes also apply to other hard-to-deposit metals such as vanadium, titanium and zirconium.

DETAILED DESCRIPTION

Figure 1:
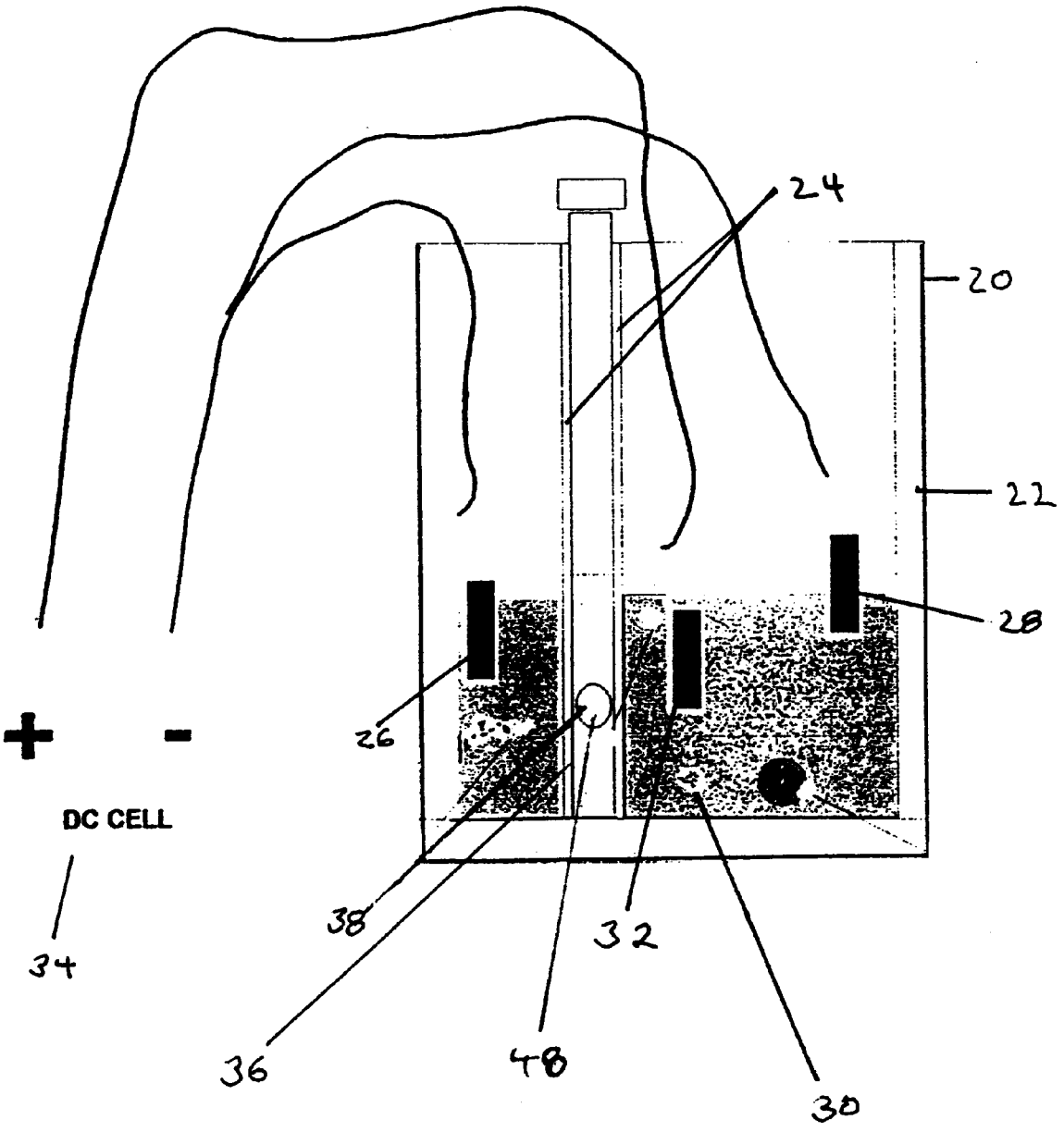
FIG. 1 is a diagrammatic representation of the novel electrochemical cell of the present invention identified as the "Mercy Cell."

The present invention describes a method of codepositing iron-manganese alloys, such deposition having from about 11 to more than about 38% manganese from an aqueous solution of about pH 0.5 to about pH 11. The aqueous solution can include a variety of compositions including sulfate, phosphate salt or any other types of bath. The electrodeposits may then be nitrided, phosphatized, or carburised to produce an amorphous surface as desired, including a surface comparable to that of Hadfield Steel. The novel method of the present invention utilizes a novel electrochemical cell.

Electrodeposits having about 15 to 38% Mn produced according to the present invention possess a bright mirror-like surface composed of a single phase supersaturated body centered cubic (b.c.c.) structure or a dark surface and is composed of hexagonal closed pack (h.c.p.) structure. Temperature significantly affects the color of the surface. Temperature above 50° C. may darken the Fe-Mn deposit. At temperatures below 10° C. the electrodeposit of Fe-Mn may also be darkened. The Fe-Mn will produce a clean, bright deposit at temperatures of about 10–50° C. Increased amount of ammonium sulfate at an excess of 200 g/l, will cause some darkness to the deposit. About 50 g/l ammonium sulfate concentration in a thoroughly filtered bath will bring about bright or white deposition of Fe-Mn alloys. Increased sulfate above 200 g/l was seen to increase the amount of Mn in deposit. However, it did not improve the surface of the Fe-Mn deposited. Of all these factors, temperature is the major determinant of color of the deposited surface.

The hardness and enhanced corrosion resistance of the Fe-Mn alloy produced in accordance with the present invention is remarkable in view of the reactive nature of elemental manganese.

The following experimental details are intended to illustrate the apparatuses, materials and methods of the present invention and obvious modifications and substitutions may become apparent to the person of ordinary skill in the art and such modifications and substitutions are intended to fall within the spirit and scope of the present invention as described and claimed.

Preparation of Electrodes

The anodes were made up of low carbon steel and pure manganese flakes cast into a solid rod. The pieces of manganese were not bagged but were successfully melted and cast into short cylindrical rods. The cathode was made up of pure copper foil cut into about 1 centimeter squares. The electrodes were thoroughly prepared as follows: First, the copper foil squares were mechanically sanded with rough and fine emery papers. They were then polished with fine diamond paste on fine linen cloth for about 30 minutes each. The copper foil squares were then rinsed with deionized water, then dilute sulfuric acid, followed by sodium hydroxide, and finally rinsed again with deionized water. The bare cathodes were then dried and weighed on the balance. They were then lacquered on one side. The cathodes were then reweighed. By substracting these values the weight of the lacquer was known and the the exact weight of the copper can be monitored. The manganese anodes were cleaned with deionized water, then dilute sulfuric acid, followed by sodium hydroxide, and finally rinsed again with deionized water.

Preparation of Electrolyte Solutions

Three solutions were prepared as follows and identified as "C", "D" and "E". Solution C: 11 g/l manganese sulfate; 30 g/l iron sulfate; 200 g/l ammonium sulfate. Solution D: 150 g/l manganese sulfate; 195 g/l iron ammonium sulfate. Solution E: 60 g/l manganese sulfate; 30 g/l iron sulfate; 200 g/l ammonium sulfate Each solution was filtered repeatedly to eliminate precipitated impurities. After preparing the solution, it should be left to age for at least 24 hours, but must be filtered before use. Not wishing to be bound by any particular theory, it is believed that ions in the new solution are highly mobile and uncontrollable when electricity is applied. When the solution has aged, the mobility of the ions in solution is decreased and the ions are more easily directed to the target cathode when the electricity is applied. Each solution was used to electroplate pure copper foil.

It is important that no soap of any kind contaminate the solutions. It was observed that soap binds to the manganese in solution and prevents deposition on rough or passivated surfaces. This may not be the case for smooth and non-passivated surfaces.

It is important to allow electrodeposits to dry naturally. If they are forced to dry by the application of external heat, the diffusion of manganese into the iron is prevented from taking place resulting in cracking and poor adhesion of the deposit to the substrate.

Results of these experiments are set forth below.

At pH 0.5 to 2.9, current density 20 MA/cm2, the copper cathode was insulated and passivated by hydrogen gas and no deposition of iron-manganese was observed. The voltage was then increased to overcome this. At current density greater than about 60 MA/cm2, iron manganese started to deposit in greater quantity. However, such a high current density caused burning of the deposit at pH from about 4 to about 10. Deposits of about 13% manganese were obtained using pH 3, temperature of about 10 to about 45° C.

The Mercy Cell

Since deposition rates greater than 13% manganese were desired, a new electrocehmical cell was developed in order to achieve this goal. This cell is called the "Mercy cell" and is shown in FIG. 1. Turning more specifically to FIG. 1, a PVC cell 20 is about 8.5 cm long, about 8 cm wide. The actual dimensions are not critical to the operation of the invention, but in this case, the cell was designed to hold about 1 gallon of liquid. The cell wall 22 is about 0.5 cm thick and the separating wall 24 is about 1.5 cm thick. Separating wall 24 separates chamber 1 from the other chamber in the cell. The separating wall 24 has a hole 48 in it near the base. Anode 26 is made of iron and anode 28 is made of manganese. Salt solution 30 comprises a simple acid salt including, but not limited to sulfate, chloride or phosphate salts. The cathode 32 is made of copper, either foil or plate. The range of pH of the aqueous solution includes pH 0.45, 1, 2, 3, 4, 5, 6, 7, 8, 9, and 10.5. The power source 34 could be alternating current or direct current. The cylindrical control rod 36 is made of a PVC plastic about 10 cm long and has a hole 38 about 0.2 cm from its base.

In operation, the control rod 36 is rotated so hole 28 in the control rod lines up with hole 38 in the separating wall 24 to allow solution to pass from one chamber to the other thus controlling the rate of migration and diffusion of the most mobile and noble metal ions which tend to deposit at the cathode J. In addition to electroplating, the cell is about 99.5% effective in separating toxic metal ions from solution to comply with environmental regulatory requirements. The cell is durable, non-magnetic, lightweight and could be modified to any desired volume.

In this new cell, about 11 to over 38% manganese was codepostied with iron on coper foil at current denisty of about 20 MA/cm2, pH 3, temperature 10 to 45° C. using solution E, described above. In this cell, the copper cathode and manganese anode were placed in the same chamber while the iron anode was placed alone in an adjacent chamber. As curent at about 20 MA/cm2 was passed to these electrodes in the cell simultaneously, the following observations were made:

1. At pH 3, manganese hydroxide precipitated, iron hydroxide did not precipitate.
2. Iron hydroxide precipitated at about pH 6.9 and higher.
3. At pH about 9.3 the manganese anode became passivated.
4. The iron anode became passivated at pH about 10.5.
5. At about pH 11.3 manganese and iron were completely passivated and the solution did not conduct electricity.
6. At pH 2.9 and below, the cathode became completely passivated by hydrogen gas and the solultion did not conduct electricity.

When current was increased, more deposition took place at lower pH values. Results of experiments conducted are summarized in the following tables. Table 1 sets forth results of experiments using Solution C; similarly Table 2 shows Solution D; and Table 3 shows Solution E. experiments using Solution C; similarly Table 2 shows Solution D; and Table 3 shows Solution E.

TABLE 1

Solution C

| SAMPLE | pH | % Mn | Time (min) | Current Density MA/cm$^2$ | Total Current MA | % Current Efficiency | Thickness (microns) | Appearance | Temp. (°C.) |
|---|---|---|---|---|---|---|---|---|---|
| A | 1.0 | 19 | 12 | 872 | 872 | 19 | | bright | 25 |
| B | 1.8 | 15 | 20 | 122 | 122 | 11.9 | 58 | bright | 25 |
| C | 2.0 | 15.7 | 12 | 59 | 59 | 15.6 | 28 | bright | 18 |
| D | 2.5 | 13.7 | 10 | 30 | 30 | 30 | 14 | bright | 25 |
| E | 3.0 | 10.6 | 5 | 20 | 20 | | | bright | 18 |
| F | 4.0 | 19 | 10 | 20 | 20 | | | bright | 18 |
| G | 5.0 | 11.3 | 10 | 20 | 20 | | | bright | 18 |
| H | 6.0 | 15.9 | 12 | 20 | 20 | 71 | 9 | bright | 25 |
| I | 6.3 | 15.6 | 20 | 20 | 20 | 14.3 | 10 | bright | 25 |
| J | 7.0 | 15.9 | 12 | 20 | 20 | 44 | 9 | bright | 25 |
| K | 9.0 | 9 | 10 | 20 | 20 | | | bright | 25 |
| L | 4.0 | 11 | 20 | 20 | 20 | | 59 | bright | 25 |
| M | 4.0 | 6 | 10 | 20 | 20 | 9.2 | | bright | 25 |
| N | 4.0 | 5 | 75 | 20 | 20 | | | bright | 25 |
| O | 2.0 | 15.7 | 10 | 70 | 70 | 15.6 | | bright | 18 |

TABLE 2

Solution D

| SAMPLE | pH | % Mn | Time (min) | Current Density MA/cm$^2$ | Total Current MA | % Current Efficiency | Thickness (microns) | Appearance | Temp. (°C.) |
|---|---|---|---|---|---|---|---|---|---|
| A | 0.75 | 6.4 | 20 | 127 | 127 | 18.6 | 55 | bright | 20 |
| B | 2.9 | 13 | 20 | 59 | 59 | | | bright | 25 |
| C | 2.3 | 25 | 12 | 100 | 100 | 43 | 26 | bright | 20 |
| D | 2.0 | 38 | 12 | 122 | 122 | 32 | 32 | bright | 20 |
| E | 3.0 | 3.4 | 20 | 56 | 56 | 53 | 24 | bright | 25 |
| F | 6.0 | 20 | 12 | 19 | 20 | 71 | 9 | bright | |
| G | 2.0 | 14 | 14 | 20 | 20 | 59 | 13 | bright | 25 |
| H | 3.0 | Unk | 12 | 120 | 15 | 15 | | dark | 9 |
| I | 6.0 | 14 | 20 | 20 | 20 | 85.7 | 11 | bright | 10 |
| J | 6.0 | Unk | 12 | 15 | 15 | | | dark | 8 |
| K | 8.0 | 9 | 20 | 20 | 20 | | | bright | 25 |
| L | 6.0 | 3.7 | 20 | 15 | 15 | 97.6 | | bright | 25 |
| M | 4.0 | 11 | 10 | 25 | 25 | | | bright | 25 |

TABLE 2-continued

| Solution D | | | | | | | | | |
|---|---|---|---|---|---|---|---|---|---|
| SAMPLE | pH | % Mn | Time (min) | Current Density MA/cm$^2$ | Total Current MA | % Current Efficiency | Thickness (microns) | Appearance | Temp. (°C.) |
| N | 3.3 | 8.4 | 20 | 59 | 59 | 70 | 26 | bright | 14 |
| O | 6.0 | 9.5 | 12 | 20 | 20 | | | bright | 10 |

TABLE 3

| Solution E | | | | | | | | |
|---|---|---|---|---|---|---|---|---|
| Sample | pH | % Mn | Time (min) | Current Density MA/cm$^2$ | Total Current MA | % Current Efficiency | Appearance | Temp. (°C.) |
| A | 1.0 | 13.2 | 20 | 20 | 20 | 29.4 | bright | 25 |
| B | 3.0 | 12.8 | 20 | 20 | 20 | | bright | 25 |
| C | 8.0 | 10 | 20 | 20 | 20 | | bright | 25 |
| D | 5.0 | 9 | 20 | 20 | 20 | | bright | 25 |
| E | 2.0 | | 10 | 69 | 10 | | dark | 8 |
| F | 4.0 | 9.3 | 20 | 20 | 20 | | bright | 25 |
| G | 7.0 | 13.2 | 10 | 20 | 10 | | bright | 25 |
| H | 7.0 | 10.0 | 10 | 23 | 10 | | bright | 25 |
| J | 8.0 | 9.5 | 23 | 20 | 23 | | bright | 25 |

These deposits were analyzed by scanning electron microscopy, transmission electron miscorscopy, x-ray diffraction, vibratory signal magnetron (VSM), rate of deposition by use of cyclic voltammetry, and micro hardness tests. These tests indicate that deposits with about 7 to 15% Mn comprise a crystalline structure of a single phase supersaturated body centered cubic; while deposits of between about 15 to 38% Mn comprise a crystalline structure comprising a mixture of body centered cubic and a hexagonal close pack structure.

The corrosion test utilized was a salt spray method, well known to the person of ordinary skill in the art. It was found that corrosion resistance increased directly with percentage of manganese deposited. The thicker deposits, above about 11 microns in thickness withstood the salt spray corrosion test better than the thinner deposits, less than about 11 microns.

The relationship of pH, current density and crystallographic orientation in the deposition of Fe-Mn alloy as observed under a scanning electron microscope is discussed.

High pH of 3–10 did not affect the high surface energy of the bare substrate, and so the deposition of iron-manganese was able to proceed at low current density of 20 MA/cm$^2$ until limited by: (a) passivation of the anodes by oxide and hydroxide thin films; (b) precipitation of the manganese hydroxide in the alloy deposit, starting at pH 3 and increasing with pH; and (c) precipitation of the ferric hydroxide, starting at pH 6 and increasing with pH; and (d) isoelectric point of the solution, at which point the solution no longer conducts electricity.

Low pH of 1–2 decreases the high surface energy of the bare copper substrate and causes instantaneous passivation of the substrate surface. Voltage was increased to raise the current density to above 60 MA/cm$^2$. Without high current density to overcome hydrogen passivation, no deposition would have taken place.

During electroplating in a direct current bath, the current efficiency was found to be very sensitive to current density and the pH of the solution. The variation of current efficiency with current density can be seen in Tables 1, 2, and 3 for the three experimental solutions C, D, E, respectively. These data indicate that the cathode current efficiencies were higher at pH 6 and at current densities of 15 or 20 MA/cm$^2$. The current gradually declined as the current density increased. In general, current efficiency increases with pH. It declines at low pH and at higher current density. The main reason for the fall and rise of the current efficiencies at a given current density and pH may be attributed to factors such as: (a) increased or decreased deposition of hydrogen atoms along with the alloyed Fe-Mn on the cathode; (b) periodic passivation of the copper cathode surface by hydrogen bubbles or hydroxide or oxygen thin films on the anode. Precipitation, impurities or high pH were observed to increase the current efficiency of the bath. Low pH was seen to decrease the current efficiency. High current density does not always result in high electrodeposition of alloy. At pH 8 the current efficiency was slightly lower at low current density and manganese in deposit was equally low (8–10% Mn) but much lower at pH 9 (4% Mn). These phenomena indicate that although current efficiency determines the proportion of current that goes to deposit metals on cathode, it is the pH of the solution that actually determines the amount of the current density hence voltage applied in the electrodeposition process. It was also found at neutral pH (pH 7), low current density of 20 MA/cm$^2$ at room temperature increased the current efficiency and produced an acceptable percentage of manganese in deposit from aqueous solution. Strongly acidic solution reduced current efficiency while increasing the rate of oxidation and dissolution of manganese and iron anodes. Mildly acid solution increased the current efficiency and slightly reduced the rate of dissolution of the anodes. A mildly alkaline solution slightly lowered the values of the current efficiency while a highly alkaline solution drastically lowered the current efficiency just as highly acidic solution did.

It appears that the ideal temperature for depositing an acceptable manganese alloy having a bright surface is about 10 to about 50° C., and most preferrably at about room temperature. At high temperatures over 60° C., little or no magnaese will codeposit with iron. At 50° C., a grey matt surface is formed on the surface of a Mn-Fe alloy from a strongly acid solution. At temperatures about 80–100° C. manganese could steel deposit, but it is quite dark. Low temperatures of about 1 to about 9° C. generate deposition rates which are very low (about 3%) and are very dark, as well.

Overall, it was found that increase in temperature, time and solution concentration increased the rate of Mn deposit. Impurities in the solution, such as chromium, for example, inhibit deposition of manganese on iron.

It was also found that the higher the percentage concentration of manganese in a phosphate bath solution, the higher the percentage of manganese deposited on the cathode. In contrast, the higher the percentatge of manganese in a sulfate bath solution, the lower the percentage of manganese deposited on the cathode.

It was also found that if high pH is used, low current density is required and electroplating process requires about 20 minutes to achieve a reasonably thick deposit. If low pH is used, high current density is required and the process requires about 10 minutes. The deposit achieved at low pH is thicker, shinier, and more adhesive than that achieved at high pH.

The solution preparation and control of mobility of ions in solution are important in achieving a superior deposit. This control is afforded by the novel electrochemical cell of the present invention, termed "The Mercy Cell". The Mercy Cell affords variable control over migration of more noble and less noble metal ions in the solution when the external voltage is applied by way of a divided cell having barrier between the chambers and a control rod which has a hole in it to selectively allow migration of ionic species. The solution inside the cell is stirred continuously with a magnetic stirrer. The control rod is manipulated periodically to enhance the mobility of the slowly diffusing ions of manganese, as described above.

Manganese and other hard to deposit materials both organic and inorganic, including, but not limited to: manganese-iron-phosphate; iron-manganese-borosilicate; iron-manganesephospur-borosilicate; iron, and titanium-chromate, for example, could be satisfactorily codeposited for critical applications without the use of a complexing agent, by use of the methods set forth in the present invention.

Surface pores of the Fe-Mn deposit made in accordance with the present invention could he tightly sealed by plasma nitriding to provide a stable protective film or inhibition against corrosion. As in the case of hardness equivalent to that of Hadfield Steel, the 11–15% Mn on Iron can be carburised with 1 or 1.2% carbon added to the steel.

Analyses of the electrodeposited Fe-Mn alloy deposit made in accordance with the present invention have been carried out by different methods.

Figure 2:
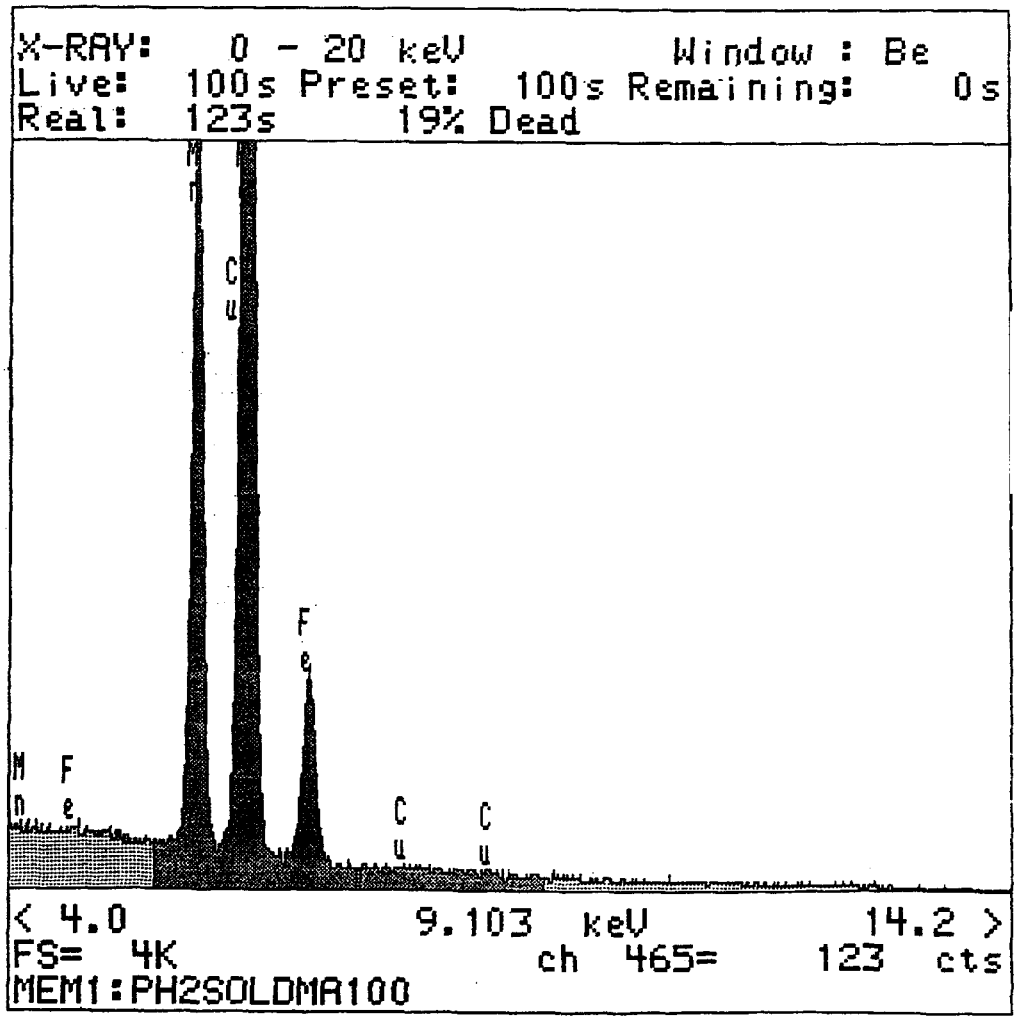
FIG. 2 is an X-ray diffraction spectrum of the deposit made in accordance with the process of the present invention.

X-ray diffraction analysis was performed on several samples of deposits made in accordance with the present invention. One such spectrum is illustrated in FIG. 2, which reflects the spectra obtained from a deposit of about 25% manganese. It was concluded from this and other spectra, that alloys of 12 to 15% manganese in a Fe-Mn deposit formed a body-centered-cubic structure, while deposits from about 16 to 38% manganese formed a hexagonal-close-packed structure. This latter group (16 to 38% Mn) exhibited a harder surface than the deposits having less manganese. The morphology of the Fe-Mn deposits varied with pH. The surfaces were examined by scanning electron microscopy and revealed that the deposits at low pH, with high current density were denser, brighter, finer, smoother, thicker, and contained a higher percentage of manganese than those which took place at high pH. The deposits which took place at high pH were bulkier, but having a thinner deposit, rougher, duller and exhibited larger grain size than those at lower pH. Hence, it concluded that lower pH is desirable for a good quality deposit, but more specifically, pH between about 2 and 4. Very low pH (below pH 2, did not result in good quality deposition.

Fe-Mn deposits having about at least 10% manganese possessed soft magnetic property and therefore could be used for magnetic shielding.

The processes of the present invention have been reproduced repeatedly in laboratory settings, as well is scaled-up industrial settings. This indicates that this process is reproducible for use in commercial applications. The processes of the present invention which generate a Fe-Mn alloy having a bright, shiny surface lends itself to use of Fe-Mn alloy for its aesthetic properties lending itself to decorating purposes as well as many commercial applications.

Although this invention has been described with respect to specific embodiments, it is not intended to be limited thereto and certain modifications and substitutions will become apparent to the person of ordinary skill in the art of electrodeposition, which modifications are intended to fall within the spirit and scope of the invention as described and claimed.

I claim:

1. A method of depositing a hard-to-deposit metal alloy onto a substrate comprising the steps of:

a) placing a hard-to-deposit metal anode into a first chamber of an electrochemical cell having at least two chambers and containing an electrolyte solution wherein the hard-to-deposit is selected from the group consisting of manganese, vanadium, titanium and zirconium;

b) placing an iron-containing anode into a second chamber of the electrochemical cell;

c) placing a cathode into the first chamber of the electrochemical cell;

d) passing electricity through the electrochemical cell for a time sufficient to cause deposition of iron and hard-to-deposit metal alloy onto the cathode;

e) allowing the deposition to continue until the desired amount of deposition is achieved;

f) stopping the flow of electricity; and g) removing the cathode which has been deposited with the iron and hard-to-deposit metal alloy.

2. The method of claim 1 wherein the hard-to-deposit metal is manganese.

3. The method of claim 1 wherein at least one of the chambers is equipped with a control rod which is selectively removed to control rate of migration and diffusion of metal ions.

4. The method of claim 2 wherein the electrolyte solution comprises: about 11 g/l manganese sulfate; about 30 g/l iron sulfate; and about 200 g/l ammonium sulfate.

5. The method of claim 2 wherein the electrolyte solution comprises: about 150 g/l manganese sulfate; and about 195 g/l iron ammonium sulfate.

6. The method of claim 2 wherein the electrolyte solution comprises: about 60 g/l manganese sulfate; about 30 g/l iron sulfate; and about 200 g/l ammonium sulfate.

7. The method of claim 2 wherein at least one of the chambers is equipped with a control rod which is selectively removed to control rate of migration and diffusion of metal ions.

8. The method of claim 2 wherein the electricity has a current density of about 10 to about 125 $MA/cm^2$.

9. The method of claim 2 wherein the pH of the solution is about pH 1.0 to about pH 9.0.

10. The method of claim 2 wherein the deposition on the cathode is about 9% to about 38% manganese.

11. The method of claim 2 wherein the deposition on the cathode is bright and shiny.

12. The method of claim 2 wherein the time sufficient to cause deposition is about 5 to about 25 minutes.

13. The method of claim 1 wherein the electricity has a current density of about 10 to about 125 $MA/cm^2$.

14. The method of claim 1 wherein the pH of the solution is about pH 1.0 to about pH 9.0.

15. The method of claim 1 wherein the time sufficient to cause deposition is about 5 to about 25 minutes.

* * * * *